US010916857B2

(12) United States Patent
Kim et al.

(10) Patent No.: US 10,916,857 B2
(45) Date of Patent: Feb. 9, 2021

(54) ANTENNA DEVICE AND METHOD FOR OPERATING ANTENNA

(71) Applicant: Samsung Electronics Co., Ltd, Suwon-si (KR)

(72) Inventors: Yoongeon Kim, Suwon-si (KR); Seungtae Ko, Suwon-si (KR); Sangho Lim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 51 days.

(21) Appl. No.: 16/331,131

(22) PCT Filed: Aug. 23, 2017

(86) PCT No.: PCT/KR2017/009180
§ 371 (c)(1),
(2) Date: Mar. 6, 2019

(87) PCT Pub. No.: WO2018/048123
PCT Pub. Date: Mar. 15, 2018

(65) Prior Publication Data

US 2019/0252788 A1 Aug. 15, 2019

(30) Foreign Application Priority Data

Sep. 6, 2016 (KR) ..... 10-2016-0114428

(51) Int. Cl.
*H01Q 13/10* (2006.01)
*H01Q 1/22* (2006.01)
(Continued)

(52) U.S. Cl.
CPC ..... *H01Q 13/10* (2013.01); *H01Q 1/22* (2013.01); *H01Q 1/3283* (2013.01); *H01Q 13/106* (2013.01); *H01Q 19/13* (2013.01)

(58) Field of Classification Search
CPC ..... H01Q 1/22; H01Q 1/24; H01Q 1/3283; H01Q 13/10; H01Q 13/106; H01Q 19/13
See application file for complete search history.

(56) References Cited

U.S. PATENT DOCUMENTS 4,287,518 A 9/1981 Frosch et al.
4,626,865 A 12/1986 Rammos
(Continued)

FOREIGN PATENT DOCUMENTS

JP 2006-135773 A 5/2006
JP 2010-062979 A 3/2010
(Continued)

OTHER PUBLICATIONS

International Search Report dated Nov. 24, 2017 in connection with International Patent Application No. PCT/KR2017/009180, 2 pages.
(Continued)

*Primary Examiner* — Jimmy T Vu

(57) ABSTRACT

Disclosed are an antenna device and a method for operating same according to various embodiments, wherein the antenna device includes: a slot formed by a first ground pattern, a second ground pattern, a third ground pattern, and a fourth ground pattern; a power supply part formed on a different surface from the surface in which the slot is formed; and a metal pattern disposed extending a predetermined distance from the power supply part and forming a vertically polarized wave. The metal pattern may be disposed at a predetermined angle to the surface in which the slot is formed. Accordingly, the antenna device may emit an electric wave even in a narrow mounting area of the antenna.

15 Claims, 16 Drawing Sheets

(51) Int. Cl.
*H01Q 1/32* (2006.01)
*H01Q 19/13* (2006.01)

(56) References Cited

U.S. PATENT DOCUMENTS

| | | | | |
|---|---|---|---|---|
| 6,031,500 | A | 2/2000 | Nagy et al. | |
| 7,948,440 | B1 | 5/2011 | Honda et al. | |
| 2005/0093751 | A1* | 5/2005 | Tamaoka | H01Q 1/36 343/702 |
| 2010/0097286 | A1 | 4/2010 | Morrow et al. | |
| 2010/0177014 | A1 | 7/2010 | Min et al. | |
| 2013/0257672 | A1* | 10/2013 | Lu | H01Q 1/525 343/843 |
| 2015/0214607 | A1 | 7/2015 | Lee et al. | |

FOREIGN PATENT DOCUMENTS

| | | | |
|---|---|---|---|
| KR | 10-2008-0083820 | A | 9/2008 |
| KR | 10-2010-0030025 | A | 3/2010 |
| KR | 10-2010-0080199 | A | 7/2010 |
| KR | 10-2015-0089490 | A | 8/2015 |
| KR | 10-2016-0027662 | A | 3/2016 |

OTHER PUBLICATIONS

Written Opinion of the International Searching Authority dated Nov. 24, 2017 in connection with International Patent Application No. PCT/KR2017/009180, 5 pages.
European Patent Office, "Supplementary European Search Report," Application No. EP17849007.4, dated Jul. 4, 2019, 8 pages.

* cited by examiner

ANTENNA DEVICE AND METHOD FOR OPERATING ANTENNA

CROSS-REFERENCE TO RELATED APPLICATIONS

This application is a 371 of International Application No. PCT/KR2017/009180 filed on Aug. 23, 2017, which claims priority to Korean Patent Application No. 10-2016-0114428 filed on Sep. 6, 2016, the disclosures of which are herein incorporated by reference in their entirety.

BACKGROUND

1. Field

The disclosure relates to an antenna and a method for operating the same. More particularly, the disclosure relates to an antenna capable of securing a sufficient ground region even in a place having many spatial limitations.

2. Description of Related Art

To meet the demand for wireless data traffic having increased since deployment of 4G communication systems, efforts have been made to develop an improved 5G or pre-5G communication system. Therefore, the 5G or pre-5G communication system is also called a 'beyond 4G Network' communication system or a 'post LTE System'. The 5G communication system is considered to be implemented in ultrahigh frequency (mmWave) bands, e.g., 60 GHz bands, so as to accomplish higher data rates. To mitigate a path loss of the radio waves and increase the transmission distance on the radio waves in the ultrahigh frequency, the beamforming, massive multiple-input multiple-output (MIMO), full dimensional MIMO (FD-MIMO), array antenna, an analog beam forming, large scale antenna techniques are discussed in 5G communication systems. In addition, in 5G communication systems, development for system network improvement is under way based on evolved small cell, advanced small cells, cloud radio access networks (cloud RANs), ultra-dense networks, device-to-device (D2D) communication, wireless backhaul, moving network, cooperative communication, coordinated multi-points (CoMP), reception-end interference cancellation and the like. In addition, in the 5G system, hybrid FSK and QAM modulation (FQAM) and sliding window superposition coding (SWSC) as an advanced coding modulation (ACM) systems, and filter bank multi carrier (FBMC), non-orthogonal multiple access (NOMA), and sparse code multiple access (SCMA) as an advanced access technology have been developed.

On the other hand, the Internet, which is a human centered connectivity network where humans generate and consume information, is now evolving to the Internet of things (IoT) where distributed entities, such as things, exchange and process information without human intervention. The Internet of everything (IoE), which is a combination of the IoT technology and the Big Data processing technology through connection with a cloud server, has emerged. As technology elements, such as "sensing technology", "wired/wireless communication and network infrastructure", "service interface technology", and "security technology" have been demanded for IoT implementation, a sensor network, a machine-to-machine (M2M) communication, machine type communication (MTC), and so forth have been recently researched. Such an IoT environment may provide intelligent Internet technology services that create a new value to human life by collecting and analyzing data generated among connected things. IoT may be applied to a variety of fields including smart home, smart building, smart city, smart car or connected cars, smart grid, health care, smart appliances and advanced medical services through convergence and combination between existing information technology (IT) and various industrial applications.

In line with this, various attempts have been made to apply 5G communication systems to IoT networks. For example, technologies such as a sensor network, machine Type communication (MTC), and machine-to-machine (M2M) communication may be implemented by beamforming, MIMO, and array antennas, which correspond to the 5G communication technology. Application of a cloud radio access network (cloud RAN) as the above-described big data processing technology may also be considered to be as an example of convergence between the 5G technology and the IoT technology.

Further, with the universality of communication schemes, such as near field communication, Bluetooth, and so on, an electronic device, for example, a mobile communication terminal, may be provided with an antenna corresponding to various different frequency bands and communication schemes for wireless communication in the respective frequency bands, and in accordance with this, an external device that communicates with such an electronic device may also be provided with an antenna. In this case, however, there may be limitations in space where the antenna is deployed depending on the size of the external device in which the antenna is installed.

As a space where an antenna is deployed in an electronic device or a space where an antenna is deployed in a separate external device is gradually reduced, there is a problem that it becomes difficult to secure ground regions used for the antenna to perform transmission or reception. If sufficient ground regions are not secured, current leak may occur as the antenna radiates radio waves, and this may cause the antenna efficiency to be decreased.

Further, in order to deploy an antenna radiating radio waves of a high-frequency range while using the space in which the existing antenna radiating radio waves of a low-frequency range is deployed as it is, it is necessary to secure wider ground regions than the ground regions used by the antenna radiating the radio waves of the low-frequency range. However, due to the spatial limitations, it is difficult to secure such wider ground regions.

Further, in order to use a slot antenna, it is necessary to secure a sufficient propagation distance of the radio waves, but due to the spatial limitations, it is difficult to use such a slot antenna.

The disclosure has been made in order to solve the above-described problems, and aspects of the disclosure provide an antenna device and a method for operating the antenna device capable of securing a ground region.

SUMMARY

In accordance with an aspect of the disclosure, an antenna device may include a slot formed by a first ground pattern, a second ground pattern, a third ground pattern, and a fourth ground pattern; a feeding part formed on a surface different from a surface on which the slot is formed; and a metal pattern deployed to extend for a predetermined distance from the feeding part and configured to form vertical polarized waves, wherein the metal pattern is deployed at a predetermined angle to the surface on which the slot is formed.

In accordance with another aspect of the disclosure, an antenna device may include a first metal pattern electrically connected to a first ground pattern and configured to radiate horizontal polarized waves; a second metal pattern deployed in a position spaced apart for a predetermined distance from the first metal pattern, and electrically connected to a second ground pattern formed in parallel to the first ground pattern, and configured to generate vertical polarized waves; a connection pattern configured to connect the first ground pattern and the second ground pattern to each other; and a slot deployed vertically to the first ground pattern and the second ground pattern, wherein the first metal pattern and the second metal pattern are formed vertically to each other in a direction of a plane that is parallel to the second ground pattern.

In accordance with still another aspect of the disclosure, an electronic device provided with an antenna device may include the antenna device; and a controller configured to control an operation of the antenna device, wherein the antenna device includes a first metal pattern electrically connected to a first ground pattern and configured to radiate horizontal polarized waves; a second metal pattern deployed in a position spaced apart for a predetermined distance from the first metal pattern, and electrically connected to a second ground pattern formed in parallel to the first ground pattern, and configured to generate vertical polarized waves; a connection pattern configured to connect the first ground pattern and the second ground pattern to each other; and a slot deployed vertically to the first ground pattern and the second ground pattern, and wherein the first metal pattern and the second metal pattern are formed vertically to each other in a direction of a plane that is parallel to the second ground pattern, and the controller is configured to control a power supplied to the first metal pattern and a power supplied to the second ground region.

According to the antenna device and a method for operating the antenna device in accordance with the aspects of the disclosure, since respective ground regions corresponding to radiation parts (metal patterns or slot) that output various radio waves are shared, wide ground regions can be secured as compared with narrow mount regions of the antenna.

According to the antenna device and a method for operating the antenna device in accordance with the aspects of the disclosure, since wide ground regions can be secured as compared with narrow mount regions of the antenna, leak current can be reduced, and thus antenna efficiency can be further increased.

According to the antenna device and a method for operating the antenna device in accordance with the aspects of the disclosure, since wide ground regions can be secured, it is possible to deploy an antenna radiating radio waves of a high-frequency range in the space in which the existing antenna radiating radio waves of a low-frequency range.

According to the antenna device and a method for operating the antenna device in accordance with the aspects of the disclosure, since metal patterns radiating radio waves in a slot antenna are deployed on a surface that is different from the surface on which the slot is formed, it is possible to use the slot antenna in a narrow mount space.

According to the antenna device and a method for operating the antenna device in accordance with the aspects of the disclosure, it is possible to radiate both vertical polarized waves and horizontal polarized waves.

According to the antenna device and a method for operating the antenna device in accordance with the aspects of the disclosure, since circular polarized waves can be generated using the vertical polarized waves and the horizontal polarized waves, the antenna efficiency can be heightened.

DETAILED DESCRIPTION

Figure 1:
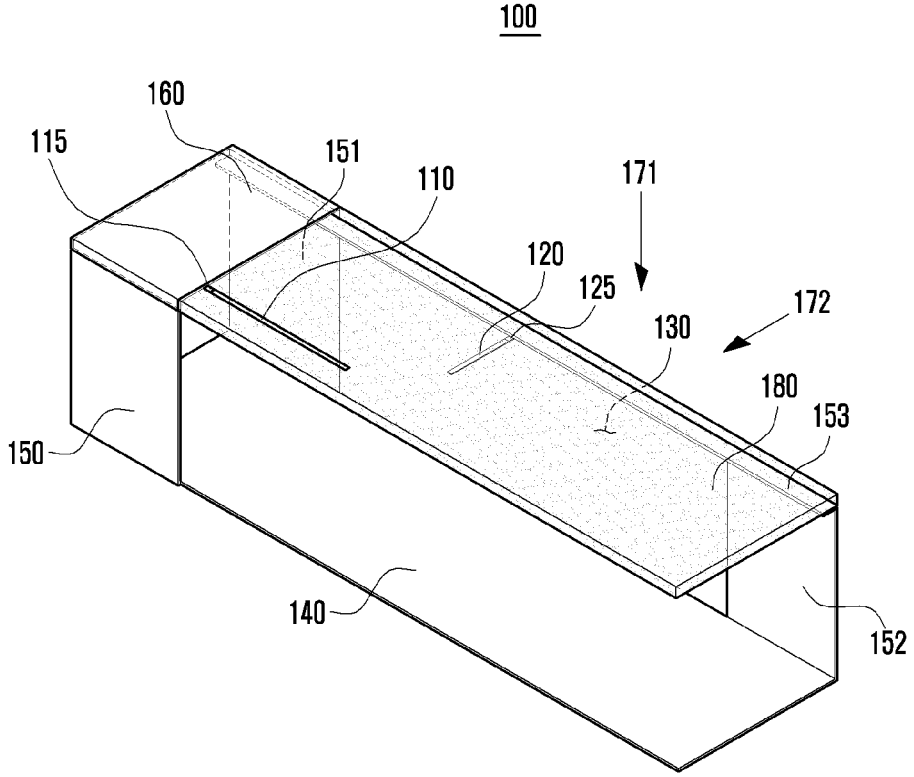
FIG. 1 is a diagram illustrating an antenna device according to various embodiments of the disclosure.

The expressions such as "include" and "may include" which may be used in the present disclosure denote the presence of the disclosed functions, operations, and constituent elements and do not limit one or more additional functions, operations, and constituent elements. In the present disclosure, the terms such as "include" and/or "have" may be construed to denote a certain characteristic, number, step, operation, constituent element, component or a combination thereof, but may not be construed to exclude the existence of or a possibility of addition of one or more other characteristics, numbers, steps, operations, constituent elements, components or combinations thereof. Furthermore, in the present disclosure, the expression "and/or" includes any and all combinations of the associated listed words. For example, the expression "A and/or B" may include A, may include B, or may include both A and B. In the present disclosure, expressions including ordinal numbers, such as "first" and "second," etc., may modify various elements. However, such elements are not limited by the above expressions. For example, the above expressions do not limit the sequence and/or importance of the elements. The above expressions are used merely for the purpose to distinguish an element from the other elements. For example, a first user device and a second user device indicate different user devices although both of them are user devices. For example, a first element could be termed a second element, and similarly, a second element could be also termed a first element without departing from the scope of the present disclosure.

In the case where a component is referred to as being "connected" or "accessed" to other component, it should be understood that not only the component is directly connected or accessed to the other component, but also there may exist another component between them. Meanwhile, in the case where a component is referred to as being "directly connected" or "directly accessed" to other component, it should be understood that there is no component therebetween. The terms used in the present disclosure are only used to describe specific various embodiments, and are not intended to limit the present disclosure. As used herein, the singular forms are intended to include the plural forms as well, unless the context clearly indicates otherwise. Singular forms are intended to include plural forms unless the context clearly indicates otherwise.

An electronic device according to the present disclosure may be a device including a communication function. For example, the device corresponds to a combination of at least one of a smartphone, a tablet Personal Computer (PC), a mobile phone, a video phone, an e-book reader, a desktop PC, a laptop PC, a netbook computer, a Personal Digital Assistant (PDA), a Portable Multimedia Player (PMP), a digital audio player, a mobile medical device, an electronic bracelet, an electronic necklace, an electronic accessory, a camera, a wearable device, an electronic clock, a wrist watch, home appliances (for example, an air-conditioner, vacuum, an oven, a microwave, a washing machine, an air cleaner, and the like), an artificial intelligence robot, a TeleVision (TV), a Digital Video Disk (DVD) player, an audio device, An electronic device according to the present disclosure may be a device including various medical devices (for example, Magnetic Resonance Angiography (MRA), Magnetic Resonance Imaging (MRI), Computed Tomography (CT), a scanning machine, a ultrasonic wave device, or the like), a navigation device, a Global Positioning System (GPS) receiver, an Event Data Recorder (EDR), a Flight Data Recorder (FDR), a set-top box, a TV box (for example, Samsung HomeSync™, Apple TV™, or Google TV™), an electronic dictionary, vehicle infotainment device, an electronic equipment for a ship (for example, navigation equipment for a ship, gyrocompass, or the like), avionics, a security device, electronic clothes, an electronic key, a camcorder, game consoles, a Head-Mounted Display (HMD), a flat panel display device, an electronic frame, an electronic album, furniture or a portion of a building/structure that includes a communication function, an electronic board, an electronic signature receiving device, a projector, and the like. It is obvious to those skilled in the art that the electronic device according to the present disclosure is not limited to the aforementioned devices.

FIG. 1 is a diagram illustrating an antenna device 100 according to various embodiments of the disclosure.

Referring to FIG. 1, an antenna device 100 may include a first metal pattern 110, a second metal pattern 120, a slot 130, a first ground pattern 160, a first connection pattern 150, a second connection pattern 151, and a second ground pattern 140. For convenience in explanation, it is assumed that the antenna illustrated in FIG. 1 is deployed on a plane that is parallel to a ground surface.

The first ground region is a region including ground having a voltage of 0V, and may mean the first ground region used for the first metal pattern 110 to radiate. The first ground region may include the first ground pattern 160, the first connection pattern 150, and the second ground pattern 140.

The first metal pattern 110 may mean a pattern radiating specific radio waves. The first metal pattern 110 may radiate specific radio waves in a specific direction using a power supplied from a first feeding part 115 connected to the first metal pattern 110. In an embodiment of the disclosure, the first metal pattern 110 may be electrically connected to the first feeding part 115 formed on a surface on which the first ground pattern 160 is formed, and may form horizontal polarized waves.

The horizontal polarized waves may mean radio waves in which the direction of an electric field is in parallel to the ground surface. In FIG. 1, the horizontal polarized waves may mean radio waves having an electric field having a direction parallel to the first ground pattern 160 deployed horizontally to the ground surface. Since the first metal pattern 110 is electrically connected to the first ground pattern 160, the direction of the electric field of the radio waves radiated from the first metal pattern 110 may be in parallel to the surface that is parallel to the first ground pattern 160 (e.g., ground surface).

In FIG. 1, the first metal pattern 110 is illustrated as a bar type pattern, but the shape of the first metal pattern 110 is not limited thereto. For example, the first metal pattern 110 may be implemented in a curved pattern.

In order to adjust the shape of the radiation pattern of the radio waves radiated from the first metal pattern, the first metal pattern 110 may be formed in a position spaced apart for a predetermined distance from the center of a substrate 180 of the first ground pattern 160. In an embodiment, the first metal pattern 110 may be formed in the position that is spaced apart for the predetermined distance from the center of the substrate 180 in the radiation direction of the radio waves. In an embodiment of the disclosure, in order to make the direction of the radio waves radiated from the first metal pattern coincide with the direction of the radio waves radiated from the slot 130, the first metal pattern 110 may be deployed at an edge portion existing in a predetermined distance from a corner created as the first connection pattern 150 and the first ground pattern 160 come in contact with each other among edge portions of the first ground pattern.

The first ground pattern 160 may be electrically connected to the second ground pattern 140 by the first connection pattern 150 and the second connection pattern 151. The second ground pattern 140 may be electrically connected to a third ground pattern 152, and the third ground pattern 152 may be electrically connected to the second connection pattern 151. Accordingly, the first ground region that can be used by the first metal pattern 110 may include the first ground pattern 160, the first connection pattern 150, the second connection pattern 151, the second ground pattern 140, the third ground pattern 152, and a fourth ground pattern 153.

In an embodiment of the disclosure, in order to output an electric field (corresponding to radio waves radiated from the first metal pattern 110) having polarized waves in a direction that is parallel to the first ground pattern 160 and the second ground pattern 140, a sufficiently long ground should be secured. However, in case where the antenna is deployed inside a car door handle, it may have the drawback that the first ground pattern 160 that is a ground in an antenna structure using the first metal pattern 110 has insufficient length. To solve this, the antenna according to an embodiment of the disclosure may include the first connection pattern 150 or the second connection pattern 151 connecting the first ground pattern and the second ground pattern to each other.

As described above, the first ground region including the first metal pattern 110, the first ground pattern 160, the second ground pattern 140, the first connection pattern 150, and the second connection pattern 151 may operate as one pole antenna outputting horizontal polarized waves.

The second metal pattern 120 may be deployed in a position that is spaced apart for a predetermined distance from the first metal pattern 110 in a vertical direction, and may be electrically connected to a second feeding point 125 formed on a surface that is parallel to a surface on which the second ground pattern 140 is formed in parallel to the first ground pattern 160. The second metal pattern 120 may be formed on a second surface facing a first surface of the substrate 180 on which the first metal pattern is formed.

The second metal pattern 120 may form vertical polarized waves using a power transferred to a second feeding part 125. The vertical polarized waves may mean radio waves having an electric field polarized in a direction that is vertical to the ground surface. In FIG. 1, the vertical polarized waves may mean radio waves having an electric field polarized in a direction that is vertical to the first ground pattern 160 and the second ground pattern 140 that are in parallel to the ground surface. The electric field of the radio waves radiated from the second metal pattern 120 may be generated in a direction directed toward the second ground pattern 140, and thus the radio waves formed by the second ground pattern 140 may mean the vertical polarized waves having the electric field in the direction that is vertical to the surface (e.g., ground surface) that is parallel to the second ground pattern 140.

The slot 130 may be deployed vertically to the first ground pattern 160 and the second ground pattern 140.

The slot 130 may be formed by the second ground pattern 140, the second connection pattern 151, the third ground pattern 152, and a fourth ground pattern 153. In an embodiment of the disclosure, the second connection pattern 151 may be physically connected to the fourth ground pattern 153, and the fourth ground pattern 153 may be connected to the second connection pattern 151 and the third ground pattern 152, and the third ground pattern 152 may be connected to the fourth ground pattern 153 and the second ground pattern 140. The slot 130 may mean a space created as the second ground pattern 140, the second connection pattern 151, the third ground pattern 152, and the fourth ground pattern 153 are connected to one another.

The vertical polarized waves formed by the second metal pattern 120 may be radiated through the slot 130. In particular, the radio waves radiated from the second metal pattern 120 may be radiated in a direction opposite to a second direction 172 via the slot 130. The electric field corresponding to the radio waves radiated through the slot 130 may be polarized waves in a vertical direction to the first ground pattern 160 and the second ground pattern 140. In an embodiment of the disclosure, the third ground pattern 152 may be physically connected to the first ground pattern 160 and the second connection pattern 151. Accordingly, the third ground pattern 152 may be electrically connected to the second connection pattern 151 and the first ground pattern 160.

As described above, the second ground region including the slot 130, the second connection pattern 151, the second ground pattern 153, the third ground pattern 152, and the fourth ground pattern 140 may operate as one pole antenna outputting the vertical polarized waves.

In an embodiment of the disclosure, the direction of the radio waves radiated from the first metal pattern 110 may coincide with or may be similar to the direction of the radio waves radiated from the slot 130. For example, the radio waves radiated from the first metal pattern 110 may be output in a first direction 172, and even the radio waves radiated from the slot 130 may be output in the first direction 172.

The electric field corresponding to the radio waves radiated from the second metal pattern 120 and the electric field corresponding to the radio waves radiated from the first metal pattern 110 may be vertical to each other. In an embodiment of the disclosure, the electric field corresponding to the radio waves radiated through the slot 130 may be polarized waves in a vertical direction to the first ground pattern 160 and the second ground pattern 140, and the electric field corresponding to the radio waves radiated from the first metal pattern 110 may be polarized waves in a parallel direction to the first ground pattern 160 and the second ground pattern 140.

The second ground region 140 may mean the ground region in the antenna structure using the slot 130. The second ground region may mean the region including the ground having the voltage of 0V. The second ground region may include the second connection pattern 151, the third ground pattern 152, the fourth ground pattern 153, and the second ground pattern 140.

In an embodiment of the disclosure, in order to output an electric field (corresponding to radio waves radiated from the first metal pattern 110) having the polarized waves in the parallel direction to the first ground pattern 160 and the second ground pattern 140 among radio waves in 2.4 GHz band, the ground having a sufficient length should be secured. However, the first ground pattern 160 that is the ground in the antenna structure using the first metal pattern 110 may have insufficient length. To solve this, the antenna according to an embodiment may include the first connection pattern 150 or the second connection pattern 151 connecting the first ground pattern and the second ground pattern to each other.

The second connection pattern 151 may be used as a ground when the slot 130 radiates radio waves, and the second connection pattern 151 may be electrically connected to the first ground pattern 160 and the fourth ground pattern 153. Accordingly, due to the second connection pattern 151, the first ground pattern 160 and the fourth ground pattern 153 may be electrically connected to each other.

The third ground pattern 152 may be physically connected to the fourth ground pattern 153 and the second ground pattern 140.

The fourth ground pattern 153 may be physically connected to the first ground pattern 160, or may not be physically connected to the first ground pattern 160, but may be electrically connected to the first ground pattern 160 by the second connection pattern 151.

The first connection pattern 150 or the second connection pattern 151 may be physically connected to the first ground pattern and the second ground pattern, and may also be electrically connected to them. Accordingly, due to the existence of the first connection pattern 150 or the second connection pattern 151, the length of the ground can be secured, and the efficiency of the output of the radio waves radiated from the first metal pattern 110 can be increased. In an embodiment of the disclosure, the first connection pattern 150 may be vertically deployed to the first ground pattern 160 and the second ground pattern 140. In this case, the electric field of the radio waves radiated from the first metal pattern 110 may be polarized waves in parallel to the first ground pattern 160 and the second ground pattern 140, and the electric field of the radio waves radiated through the slot 130 may be polarized waves in a vertical direction to the connection pattern 150. Through this, the antenna according to an embodiment of the disclosure may generate the vertical pattern and the horizontal pattern corresponding to two vertical polarized waves.

In another embodiment of the disclosure, the first connection pattern 150 or the second connection pattern 151 may be deployed in the form of a curve connecting the first ground pattern 160 and the second ground pattern 140 to each other. As described above, due to the existence of the first connection pattern 150 or the second connection pattern 151, two vertical polarized waves can be generated.

The first connection pattern 150 or the second connection pattern 151 may be differently deployed depending on the antenna deployment structure according to various embodiments of the disclosure. As described above, the first connection pattern 150 or the second connection pattern 151 may connect the first ground pattern and the second ground pattern to each other, may secure the ground region in which the first ground region and the second ground region are added together, and may have the effect that the size of the ground region used for the first metal pattern 110 to radiate can be increased.

Figure 5A:
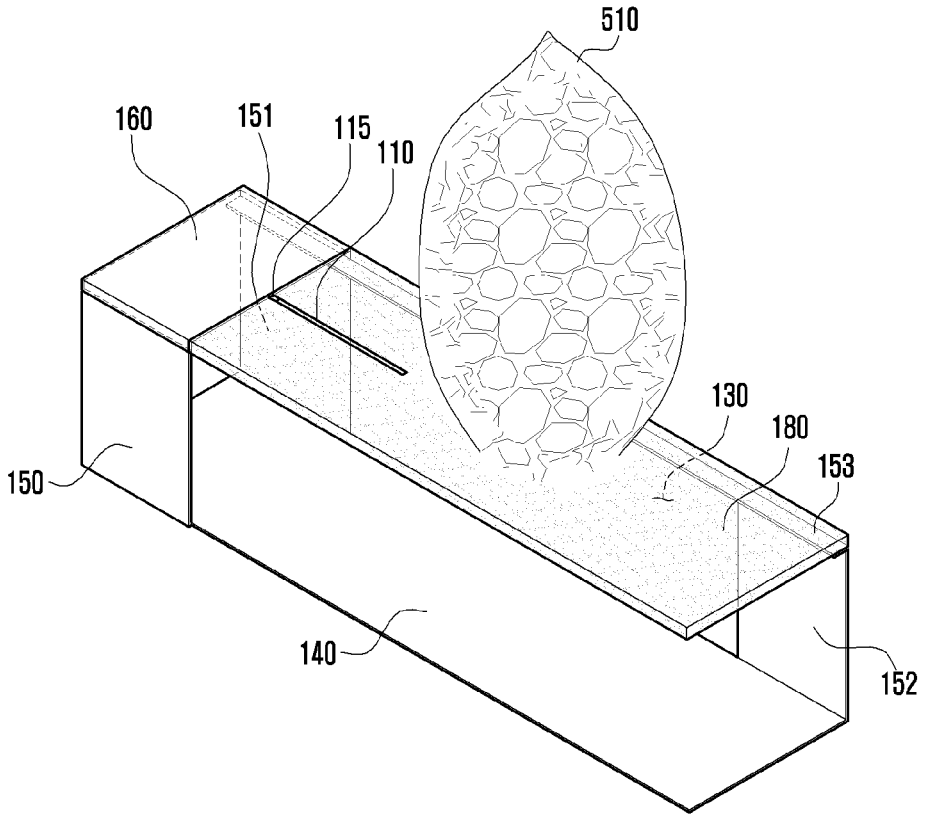
FIGS. 5A to 5D are diagrams illustrating radiation patterns radiated by an antenna according to various embodiments of the disclosure.

If the first metal pattern 110 radiates radio waves corresponding to 2.4 GHz in an antenna structure in which the first connection pattern 150 or the second connection pattern 151 does not exist (see FIGS. 5A and 5B), the first ground pattern 160 should secure the ground region of about 10 cm. However, if the first ground pattern 160 is equal to or shorter than 10 cm, a sufficient ground region may not be secured. Due to this, current leak may occur to lower the output of the radio waves. However, if the first connection pattern 150 or the second connection pattern 151 is deployed, the second ground pattern 140, the third ground pattern 152, the fourth ground pattern 153, and the first ground pattern 160 may be electrically connected to one another. The first connection pattern 150 and the second connection pattern 151 may serve to share the ground region used for the first metal pattern 110 and the slot 130 to radiate, and through this, the size of the ground region can be increased in effect. Accordingly, current leak can be reduced, and thus the strength of the radio waves radiated by the first metal pattern 110 can be increased in effect. Referring to FIG. 5A, it can be identified that the radio waves 410 radiated by the first metal pattern 110 are radiated in a vertical direction to the ground surface.

Figure 4A:
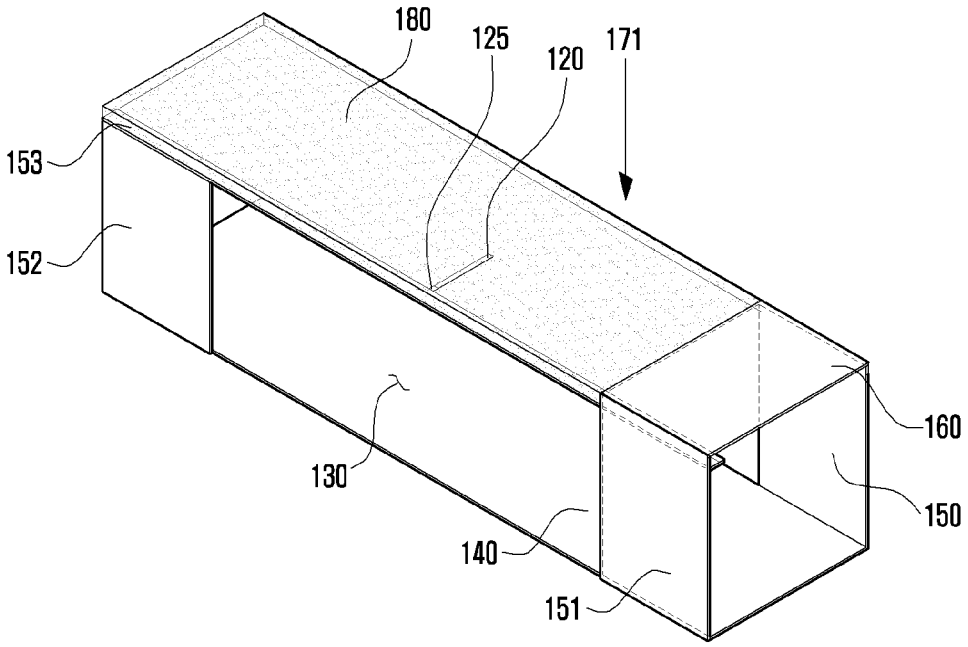
FIGS. 4A and 4B are diagrams illustrating an antenna device according to another embodiment of the disclosure.
Figure 5B:
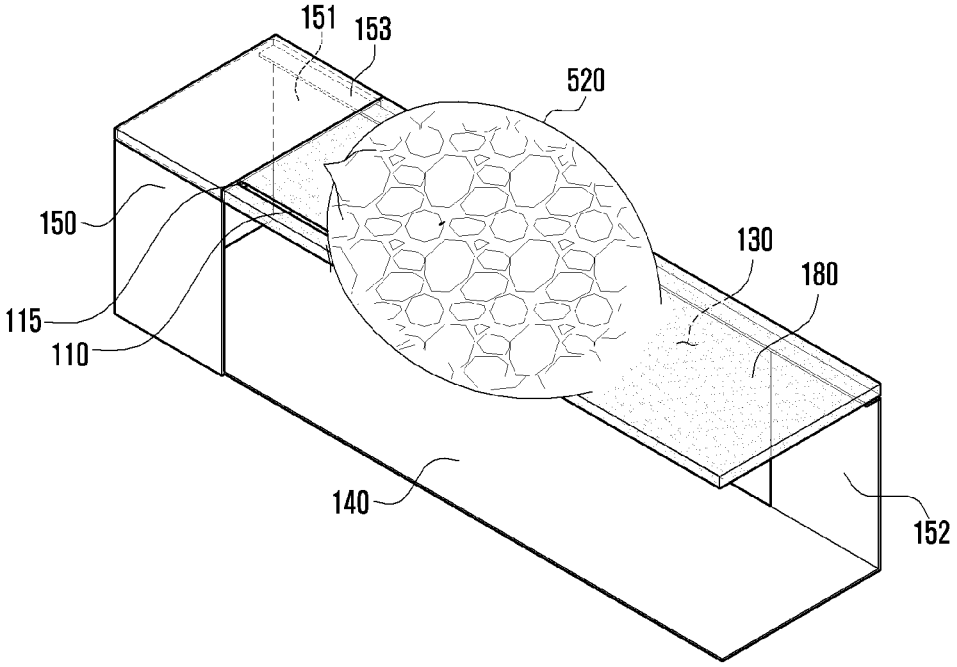

Referring to FIG. 5B, if the first metal pattern 110 is located at an edge of the first ground pattern 160, the radio waves 410 may be radiated in an inclined direction to the ground surface as compared with the radiation direction of the radiated radio waves 410 in FIG. 4A.

As described above, explanation has been made on the assumption that the radio waves corresponding to 2.4 GHz are radiated, but the frequency band of the radio waves radiated by the antenna according to an embodiment of the disclosure is not limited thereto.

Figure 5C:
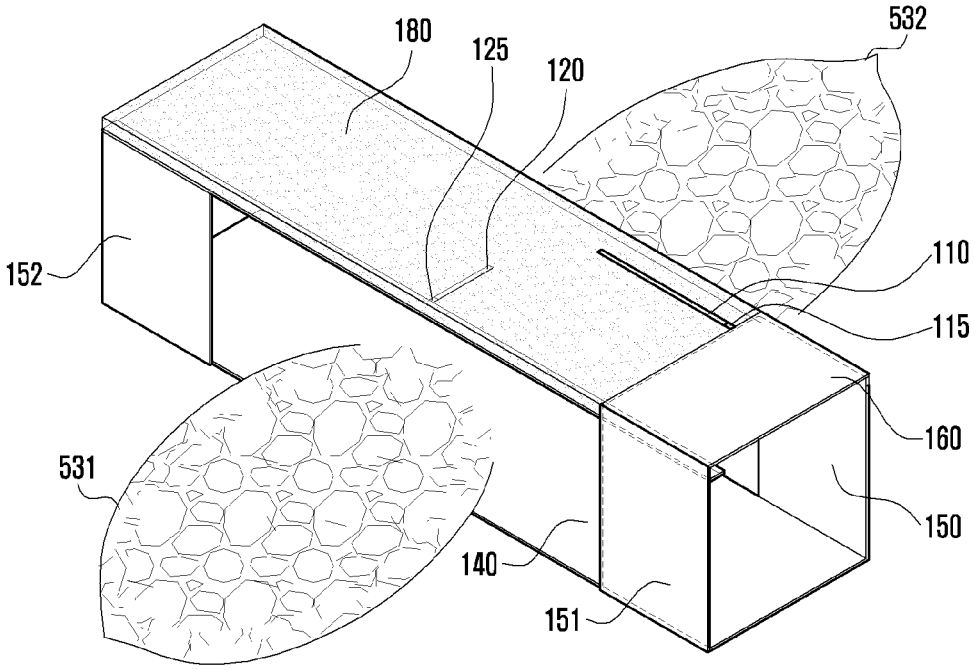

If the slot 130 connected to the second metal pattern 120 radiates the radio waves corresponding to 2.4 GHz in the antenna device according to various embodiments of the disclosure, the second ground region including the second ground pattern 140, the third ground pattern 152, the fourth ground pattern 153, and the second connection pattern 151 should secure the ground region of 10 cm. However, if the second ground region is equal to or shorter than 10 cm, a sufficient ground region may not be secured. However, if the first connection pattern 150 is deployed, the second ground pattern 140 and the first ground pattern 160 may be electrically connected to each other. The connection pattern 150 may serve to share the ground region, and through this, the size of the ground region can be increased in effect. Accordingly, current leak can be reduced, and thus the strength of the radio waves radiated by the slot 130 can be increased in effect. Referring to FIG. 5C, it can be identified that the radio waves 531 and 532 radiated by the slot 130 are radiated in a parallel direction to the ground surface.

In an embodiment of the disclosure, the antenna may further include the substrate 180. The substrate 180 may be made of a dielectric material, and the kind of the dielectric material may be differently configured depending on the frequency of the radio waves transmitted and received through the antenna. The deployment structure of the substrate 180 will be described later with reference to FIG. 2.

Figure 2:
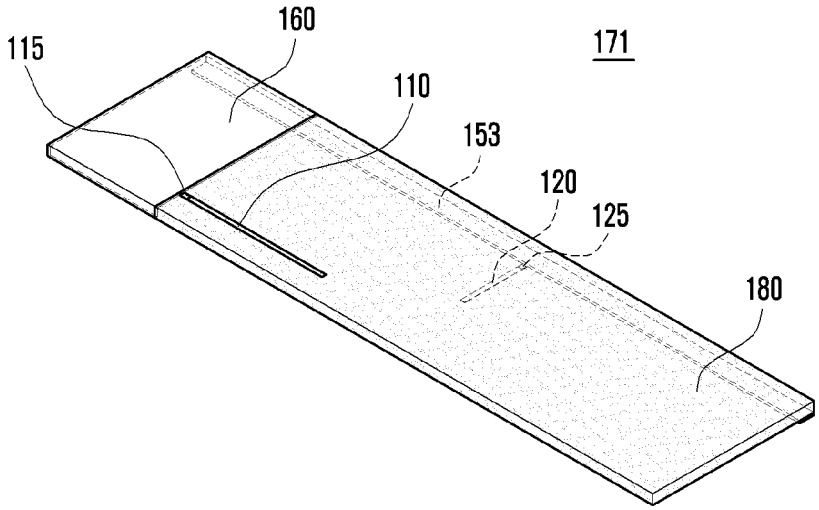
FIG. 2 is a diagram illustrating an antenna device as seen in a specific direction 171 illustrated in FIG. 1.

FIG. 2 is a diagram illustrating an antenna device as seen in a specific direction 171 illustrated in FIG. 1.

Referring to FIG. 2, the first metal pattern 110 may be connected to the first ground pattern 160.

The second metal pattern 120 may be spaced apart from the first metal pattern 110, and may be vertically deployed to the first metal pattern 110. Further, the substrate 180 may be deployed in a space that is spaced apart from the second metal pattern 120 and the first metal pattern 110.

That is, in the antenna structure according to an embodiment of the disclosure, the first metal pattern 110 may be deployed on the substrate 180, and the second metal pattern 120 may be deployed below the substrate 180.

In another embodiment of the disclosure, the first metal pattern 110 may be deployed on an upper portion of the substrate 180 of the antenna, and the second metal pattern 120 may be deployed on a lower portion of the substrate 180.

The second feeding part 125 connected to the second metal pattern 120 may be connected to the fourth ground pattern 153. In an embodiment of the disclosure, the fourth ground pattern 153 may be physically connected to the first ground pattern 160. In another embodiment of the disclosure, the fourth ground pattern 153 may be physically connected to the second connection pattern 151 other than the first ground pattern 160, and may be electrically connected to the first ground pattern 160 by the second connection pattern 151.

The propagation direction of the radio waves radiated from the first metal pattern 110 may be similar to the propagation direction of the radio waves radiated from the slot 130. This will be described later with reference to FIGS. 5A to 5D.

Figure 3:
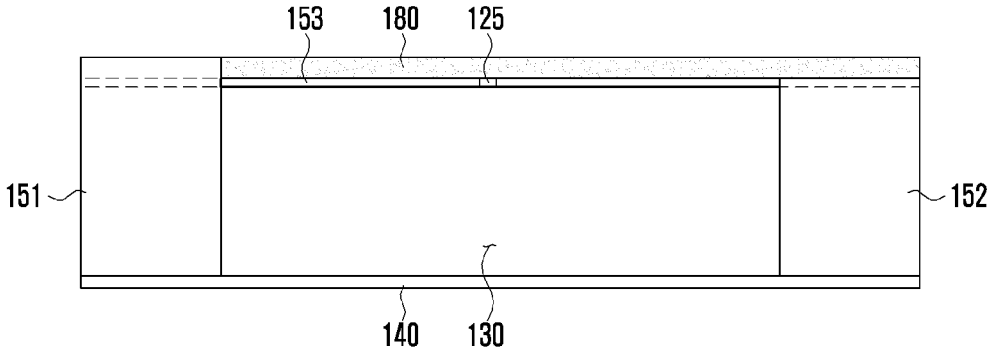
FIG. 3 is a diagram illustrating an antenna device as seen in a specific direction 172 illustrated in FIG. 1.

FIG. 3 is a diagram illustrating an antenna device as seen in a specific direction 172 illustrated in FIG. 1.

Referring to FIG. 3, the slot 130 may mean a surface formed as the second connection pattern 151, the third ground pattern 152, the fourth ground pattern 153, and the second ground pattern 140 meet one another.

In an embodiment of the disclosure, the second connection pattern 151 may be deployed on the right side of the slot 130, and the third ground pattern 152 may be deployed on the left side of the slot 130. The fourth ground pattern 153 may be deployed on the upper portion of the slot 130, and the second ground pattern 140 may be deployed on the lower portion of the slot 130.

As described above, the electric field of the radio waves radiated through the slot 130 may correspond to polarized waves in a direction in which the fourth ground pattern 153 and the second ground pattern 140 are connected to each other.

The electric field corresponding to the radio waves radiated from the slot 130 may correspond to the polarized waves in the vertical direction to the substrate 180. If the antenna is deployed so that the substrate becomes in parallel to the ground surface, the radio waves generated by the second metal pattern 120 and radiated from the slot 130 through the power supply from the second feeding part 125 may have the characteristics of the vertical polarized waves. As illustrated in FIG. 3, it can be identified that the electric field propagates in the vertical direction to the ground surface.

In the antenna according to various embodiments of the disclosure, the direction of the polarized waves radiated through the slot 130 and the direction of the polarized waves radiated by the first metal pattern 110 are vertical to each other. For example, if the antenna illustrated in FIG. 1 is deployed on the ground, the radio waves radiated by the first metal pattern 110 may be horizontal polarized waves, and the radio waves radiated through the slot 130 may be vertical polarized waves. That is, the antenna according to various embodiments of the disclosure can generated both the horizontal polarized waves and the vertical polarized waves.

For this, an electronic device provided with the antenna as illustrated in FIG. 1 may be provided with a separate processor (not illustrated).

The processor may control plural hardware or software constituent elements connected to the processor by driving, for example, an operating system or an application program, and may perform various kinds of data processes and operations. The processor may be implemented by, for example, system on chip (SoC). In an embodiment, the processor may further include a graphic processing unit (GPU) and/or an image signal processor. The processor may load a command or data received from at least one of other constituent elements (e.g., nonvolatile memories) in a volatile memory to process the loaded command or data, and may store the resultant data in a nonvolatile memory.

In an embodiment of the disclosure, the processor may control the radio waves radiated from the antenna as controlling the power supplied to the first metal pattern 110 or the power supplied to the second metal pattern 120.

Accordingly, the processor may generate circular polarized waves in which the horizontal polarized waves and the vertical polarized waves are combined with each other by controlling the power supplied to the first metal pattern 110 and the power supplied to the second metal pattern 120.

The processor may generate the polarized waves as controlling the phases of the power supplied to the first metal pattern 110 and the power supplied to the second metal pattern 120.

The processor may control the phases of the power supplied to the first metal pattern 110 and the power supplied to the second metal pattern 120 based on the rotation direction of the circular polarized waves. For example, if the rotation direction of the circular polarized waves is counterclockwise (RHCP) and clockwise (LHCP), the processor may differently control the phases of the power supplied to the first metal pattern 110 and the power supplied to the second metal pattern 120.

The circular polarized waves may mean circular polarized waves or elliptical polarized waves.

FIG. 4A is a diagram illustrating an antenna device according to another embodiment of the disclosure.

Referring to FIG. 4A, an antenna device according to another embodiment of the disclosure may include a slot 130, a feeding part 125, and a metal pattern 120.

The slot 130 may be formed by a second ground pattern 140, a second connection pattern 151, a third ground pattern 152, and a fourth ground pattern 153. The slot 130 may radiate radio waves (vertical polarized waves).

The feeding part 125 may supply a power to the metal pattern 120, and may be formed on a surface that is different from a surface on which the slot 130 is formed. For example, if the slot 130 is deployed on x-y plane, the feeding part 125 may be deployed on another plane (e.g., y-z plane) that is not parallel to the slot 130.

The metal pattern 120 may be deployed to extend for a predetermined distance from the feeding part 125, and may generate the vertical polarized waves. In an embodiment of the disclosure, the metal pattern 120 may be deployed to form a predetermined angle to the surface on which the slot is formed. For example, the metal pattern 120 may be deployed at right angles to the surface on which the slot 130 is formed. That is, the metal pattern 12*p* may be deployed vertically to the surface on which the slot 130 is formed.

In various embodiments of the disclosure, the metal pattern 120 and the feeding part 125 may be deployed to form a predetermined angle that is not 90 degrees to the surface on which the slot 130 is formed. For example, the metal pattern 120 and the feeding part 125 may be deployed on the lower surface of the substrate 180 as forming 80 degrees to the surface on which the slot 130 is formed.

In the antenna device according to various embodiments of the disclosure, in contrast with the existing antenna device, the feeding part 125 and the metal pattern 120 may be formed on another surface that is not in parallel to the surface on which the slot 130 is formed. Through this, even in a narrow space in which the antenna device according to various embodiments of the disclosure, the vertical polarized waves can be effectively radiated.

Figure 4B:
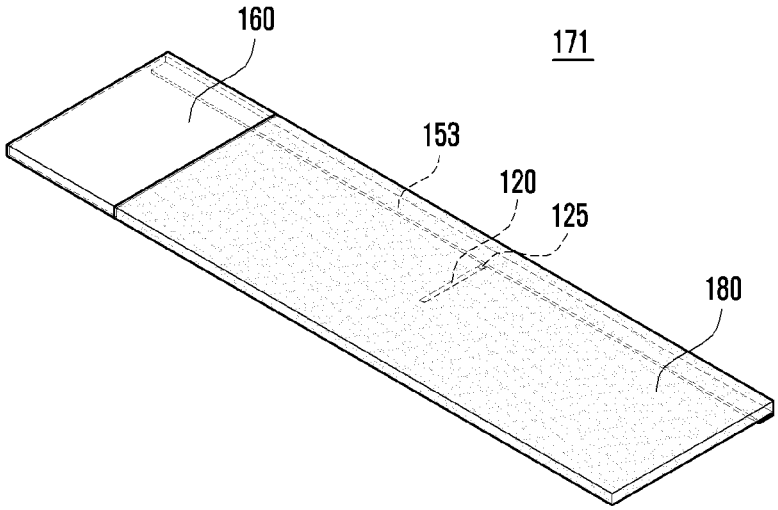

FIG. 4B is a diagram illustrating an antenna device as illustrated in FIG. 4A as seen in a specific direction 171.

Referring to FIG. 4B, the fourth ground pattern 153 connected to the first ground pattern 160 that forms an upper end of the slot may be connected to a feeding part 120. In particular, it can be identified that the feeding part 120 is deployed on another surface that is different from the surface on which the slot (not illustrated) is formed. Although FIG. 4B illustrates that the feeding part 120 and the metal pattern 125 are formed on the surface that is vertical to the surface on which the slot is formed, it is not always necessary that the feeding part 120 and the metal pattern 125 meet vertically to the surface on which the slot is formed. For example, the feeding part 120 and the metal pattern 125 may be deployed on a virtual surface that forms a specific angle to the surface (e.g., x-y plane) on which the slot is formed.

Figure 5D:
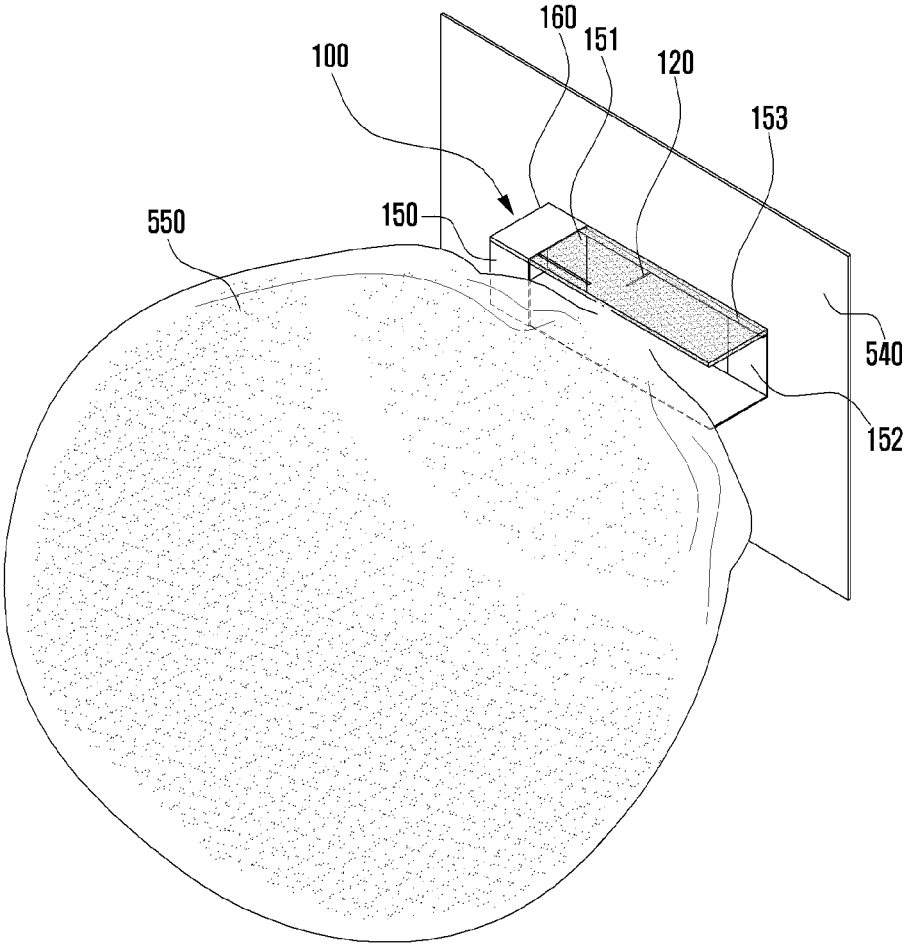

FIG. 5D is a diagram illustrating an example in which an antenna according to various embodiments of the disclosure radiates vertical polarized waves and horizontal polarized waves.

Referring to FIG. 5D, a radiation pattern 550 of the radio waves radiated by the antenna 100 and a flat plate 540 on the back side of the antenna are illustrated.

As described above with reference to FIG. 1, the first metal pattern 110 of the antenna 100 may form the horizontal polarized waves and the second metal pattern 120 may form the horizontal polarized waves.

In an embodiment of the disclosure, in order to make the propagation direction of the horizontal polarized waves formed by the first metal pattern 110 coincide with the propagation direction of the vertical polarized waves formed by the second metal pattern 120, the first metal pattern 110 may be deployed at an edge located far apart from the slot among edges of the first ground pattern 160. Further, in order to make the direction of the radio waves radiated by the first metal pattern 110 and the second metal pattern 120 parallel to the ground surface, the antenna may be deployed in front of the flat plate 540. The type and material of the flat plate 540 are not limited. In an embodiment, the flat plate 540 may mean a rectangular flat plate formed of a metal conductor, and may be deployed spaced apart for a predetermine distance from the antenna 100. The horizontal polarized waves radiated by the first metal pattern 110 and the vertical polarized waves radiated by the slot 130 may be reflected by the flat plate 510. Through this, the propagation direction of the horizontal polarized waves formed by the first metal pattern 110 may coincide with or may be similar to the propagation direction of the vertical polarized waves radiated from the slot 130, and the polarized waves may be radiated in a vertical direction to the flat plate 540. Referring to FIGS. 5A to 5D, it can be identified that the propagation direction of the horizontal polarized waves formed by the first metal pattern 110 is similar to the propagation direction of the of the vertical polarized waves formed by the second metal pattern 120, and the radiation pattern 500 radiates the vertical polarized waves and the horizontal polarized waves in a parallel direction to the ground surface.

FIGS. 6 to 9 are diagrams explaining examples of antenna application according to various embodiments of the disclosure.

Figure 6:
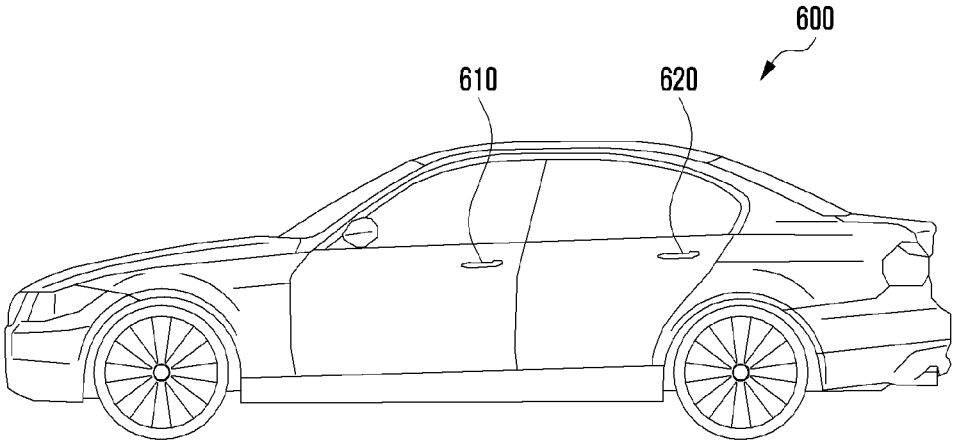
FIGS. 6 to 9 are diagrams explaining examples of antenna application according to various embodiments of the disclosure.

FIG. 6 is a diagram illustrating an automobile 600, and door handles 610 and 620 are deployed on side doors of the automobile 600.

Figure 7:
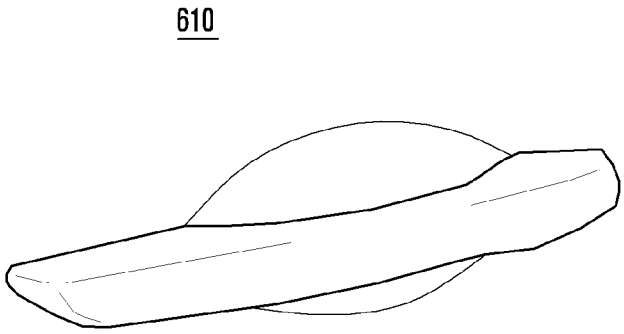

FIG. 7 is an enlarged diagram of the door handle 610 illustrated in FIG. 6. In general, the height of the door handle deployed on the automobile 600 is equal to or smaller than 3 cm, and the width may be equal to or smaller than 20 cm. Inside the door handles 610 and 620, antennas for communication between an electronic device outside the automobile and the automobile may be deployed.

In order to perform communication with the automobile 600, the electronic device outside the automobile may be provided with a communication module capable of receiving and transmitting frequencies for the communication with the automobile 600.

Figure 8:
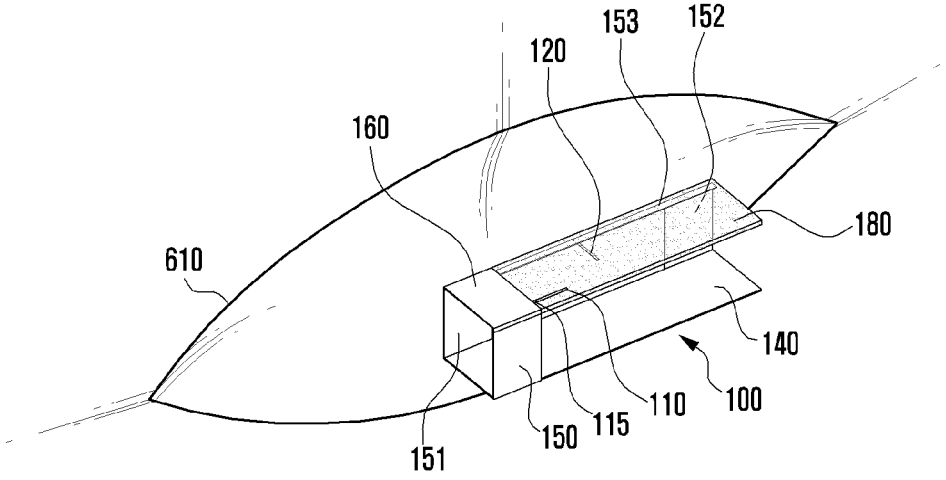

FIG. 8 is a diagram illustrating that an antenna 810 having the same structure as that of the antenna illustrated in FIG. 1 is deployed inside the door handle 610.

In accordance with the frequency band used for the communication between the automobile 600 and the external electronic device, the length of the ground region to be secured in the antenna may differ. For example, in case of performing communication between the automobile 600 and the electronic device using Wi-Fi or Bluetooth, the communication can be performed using a signal having the frequency band of 2.4 GHz. If the frequency band is 2.4 GHz, the ground region of 10 cm may be necessary in radiating the horizontal polarized waves through the antenna.

In case of the first ground pattern 160 corresponding to the first metal pattern 110 that radiates the radio waves having the horizontal polarized waves in parallel to the ground surface, it is not possible to secure the ground region of 10 cm in consideration of the height of the door handle (about 2 cm).

In case of the second ground pattern 140 corresponding to the slot 130 that radiates the radio waves having the vertical polarized waves vertical to the ground surface, it is possible to secure the ground region of 10 cm in consideration of the width of the door handle (about 10 to 20 cm).

In the antenna according to various embodiments of the disclosure, the connection pattern 150 may electrically connect the first ground pattern and the second ground pattern to each other. Due to the first connection pattern 150 or the second connection pattern 151, the ground region corresponding to the first metal pattern 110 radiating the radio waves having the horizontal polarized waves in parallel to the ground surface may include both the first ground pattern and the second ground pattern. Accordingly, the first metal pattern 110 can secure the ground region having a sufficient length.

Figure 9:
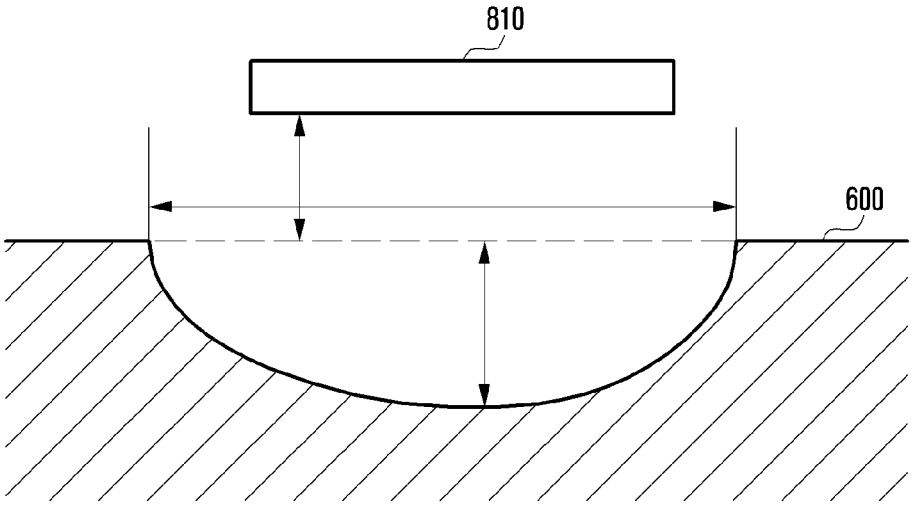

FIG. 9 is a diagram illustrating an antenna 810 deployed inside a door handle 610 and an automobile 600.

If the distance between an antenna and a conductor corresponds to ¼ of the wavelength of radio waves transmitted or received through the antenna, the radio waves radiated by the antenna and the radio waves reflected from the conductor have the same phase, and the strength of the output radio waves may be increased (analysis according to an image theory). Since the exterior of the automobile 600 is made of a metal, it may correspond to a conductor. It can be identified that the distance between the antenna 810 and the automobile 600 is about 3 to 4.5 cm. If the band in which the automobile 600 and the external electronic device communicate with each other is 2.4 GHz, the wavelength of the radio waves corresponds to 10 cm, and the distance between the antenna 810 and the automobile 600 corresponds to 2.5 cm that is ¼ of the wavelength (10 cm) of the radio waves, resulting in the increase of a gain.

Although it is assumed that the frequency for performing communication between the automobile 600 and the electronic device is 2.4 GHz in FIGS. 6 to 9, the antenna according to the disclosure can also be used to perform communication using different frequency bands.

Using the antenna according to various embodiments of the disclosure, the automobile 600 and the electronic device can perform communication with each other. For example, the electronic device may transmit a signal for controlling opening/closing of the door of the automobile 600. The automobile 600 may receive the signal using the antenna 810, and may control opening or closing of the door that is an operation corresponding to the received signal. As another example, the electronic device may start ignition of the automobile 600 or may make the automobile 600 in a standby state. The automobile 600 may receive the signal using the antenna 710, and may perform operations, such as ignition start and standby state of the automobile 600, corresponding to the received signal.

Figure 10A:
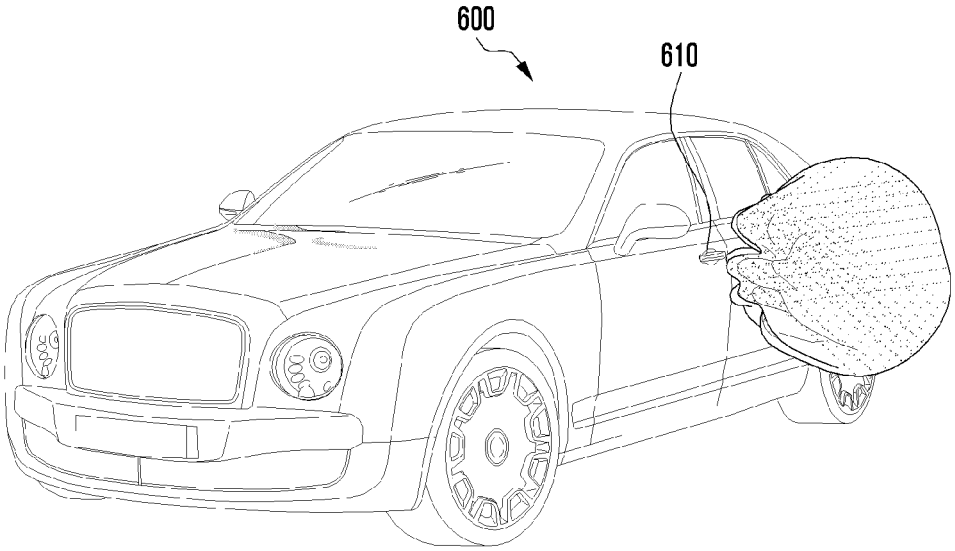
FIGS. 10A and 10B are diagrams explaining radiation of radio waves through an antenna.
Figure 10B:
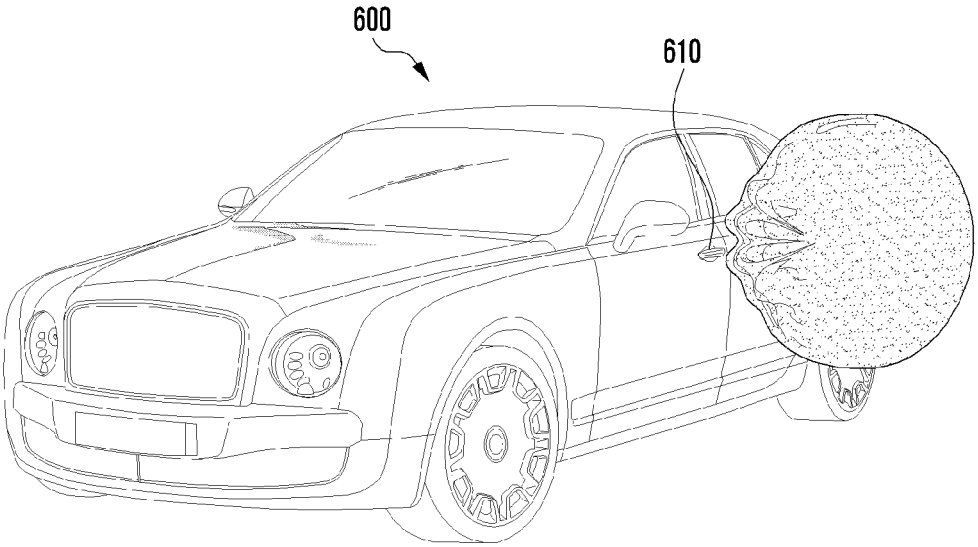

FIGS. 10A and 10B are diagrams explaining radiation of radio waves through an antenna illustrated in FIG. 9. FIG. 10A illustrates radiation of radio waves radiated by a slot 130 in a dielectric material (e.g., air), and FIG. 10B illustrates radiation of radio waves radiated by a first metal pattern 110 in a dielectric material (e.g., air).

As described above, the slot 130 may radiate the radio waves having the polarized waves in a vertical direction to the ground surface, and the first metal pattern may radiate the radio waves having the polarized waves in a horizontal direction to the ground surface.

In an embodiment of the disclosure, in order to make the propagation direction of the radio waves having the polarized waves in the vertical direction to the ground surface coincide with the propagation direction of the radio waves having the polarized waves in the horizontal direction to the ground surface, the first metal pattern 110 may be deployed at an edge of a first surface. Accordingly, it can be identified that the propagation direction of the radio waves having the polarized waves in the vertical direction to the ground surface as illustrated in FIG. 10A is almost similar to the propagation direction of the radio waves having the polarized waves in the horizontal direction to the ground as illustrated in FIG. 10B.

Figure 11:
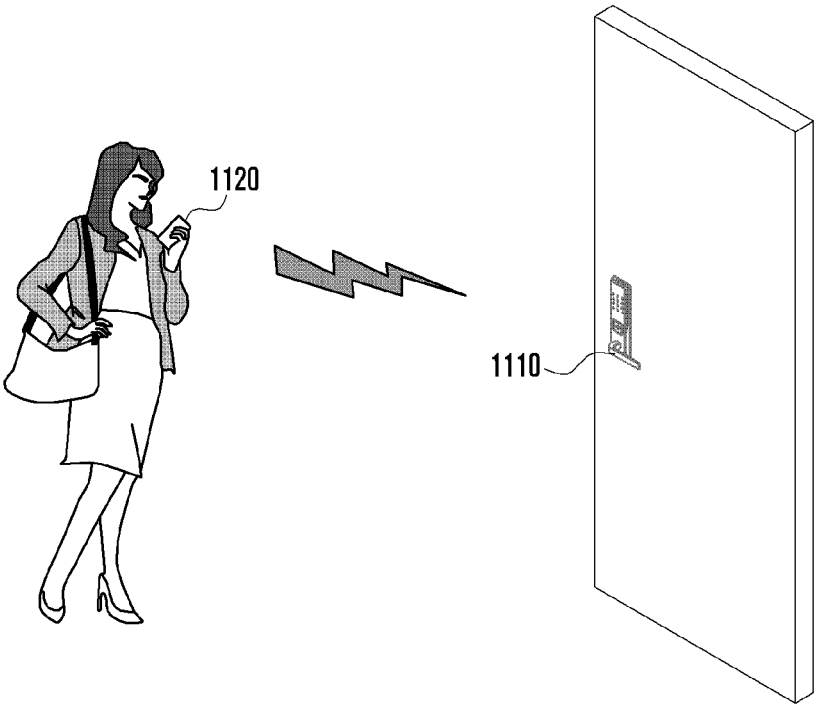
FIG. 11 is a diagram explaining an example of antenna application according to various embodiments of the disclosure.

FIG. 11 is a diagram explaining an example of antenna application according to various embodiments of the disclosure.

Referring to FIG. 11, an antenna may be deployed inside a handle of a hinged door, and communication may be performed between an electronic device and a controller deployed on the hinged door. For example, the electronic device may transmit a signal for requesting opening or closing of the hinged door. The controller of the hinged door may receive the signal using the antenna according to various embodiments of the disclosure, and may control to perform the operation of the hinged door.

According to various embodiments of the disclosure, an antenna device may include a slot formed by a first ground pattern, a second ground pattern, a third ground pattern, and a fourth ground pattern; a feeding part formed on a surface different from a surface on which the slot is formed; and a metal pattern deployed to extend for a predetermined distance from the feeding part and configured to form vertical polarized waves, wherein the metal pattern is deployed at a predetermined angle to the surface on which the slot is formed.

According to various embodiments of the disclosure, an antenna device may include a first metal pattern electrically connected to a first ground pattern and configured to radiate horizontal polarized waves; a second metal pattern deployed in a position spaced apart for a predetermined distance from the first metal pattern, and electrically connected to a second ground pattern formed in parallel to the first ground pattern, and configured to generate vertical polarized waves; a connection pattern configured to connect the first ground pattern and the second ground pattern to each other; and a slot deployed vertically to the first ground pattern and the second ground pattern, wherein the first metal pattern and the second metal pattern are formed vertically to each other in a direction of a plane that is parallel to the second ground pattern.

The antenna device according to various embodiments of the disclosure may further include a substrate, and the first metal pattern may be formed on a first surface of the substrate, and the second metal pattern may be formed on a second surface facing the first surface of the substrate.

In the antenna device according to various embodiments of the disclosure, the connection pattern may include a first connection pattern configured to connect the first ground pattern and the second ground pattern to each other and deployed in a direction facing the slot; and a second connection pattern configured to connect the first ground pattern and the second ground pattern to each other and to form one surface of the slot.

In the antenna device according to various embodiments of the disclosure, the slot may be formed by the second connection pattern, the second ground pattern, a third ground pattern, and a fourth ground pattern.

In the antenna device according to various embodiments of the disclosure, the first ground pattern may be formed on the first surface of the substrate.

In the antenna device according to various embodiments of the disclosure, the first metal pattern may be electrically connected to an edge existing in a predetermined distance from a corner created as the first connection pattern and the first ground pattern come in contact with each other among edge portions of the first ground pattern.

In the antenna device according to various embodiments of the disclosure, the first metal pattern may be formed at a corner created as the first connection pattern and the first ground pattern come in contact with each other.

In the antenna device according to various embodiments of the disclosure, a propagation direction of a radiation pattern radiated from the first metal pattern may coincide with a propagation direction of a radiation pattern output from the slot.

In the antenna device according to various embodiments of the disclosure, the second metal pattern may be connected to an upper end portion or a lower end portion of the slot.

According to various embodiments of the disclosure, an electronic device provided with an antenna device may include the antenna device; and a controller configured to control an operation of the antenna device, wherein the antenna device includes a first metal pattern electrically connected to a first ground pattern and configured to radiate horizontal polarized waves; a second metal pattern deployed in a position spaced apart for a predetermined distance from the first metal pattern, and electrically connected to a second ground pattern formed in parallel to the first ground pattern, and configured to generate vertical polarized waves; a connection pattern configured to connect the first ground pattern and the second ground pattern to each other; and a slot deployed vertically to the first ground pattern and the second ground pattern, and wherein the first metal pattern and the second metal pattern are formed vertically to each other in a direction of a plane that is parallel to the second ground pattern, and the controller is configured to control a power supplied to the first metal pattern and a power supplied to the second ground pattern.

In the electronic device provided with the antenna device according to various embodiments of the disclosure, the controller may be configured to generate polarized waves as controlling phases of a power supplied to the first metal pattern and a power supplied to the second metal pattern, and the polarized waves may include any one of the vertical polarized waves, the horizontal polarized waves, and circular polarized waves.

In the electronic device provided with the antenna device according to various embodiments of the disclosure, the controller may be configured to control a power supplied to the first metal pattern and a power supplied to the second metal pattern based on a rotation direction of the circular polarized waves.

In the electronic device provided with the antenna device according to various embodiments of the disclosure, the controller may be configured to generate the circular polarized waves as controlling phases of a power supplied to the first feeding part and a power supplied to the second feeding part.

The term "module" as used in the present disclosure may mean a unit including one of hardware, software, and firmware or any combination of two or more of them. For example, the "module" may be interchangeable with the term "logic", "logical block", "component", or "circuit". The "module" may be the smallest unit of an integrated component or a part thereof. The "module" may be the smallest unit that performs one or more functions or a part thereof. The "module" may be mechanically or electronically implemented. For example, the "module" may include at least one of an application-specific integrated circuit (ASIC) chip, a field-programmable gate arrays (FPGA), and a programmable-logic device for performing certain operations, which are now known or will be developed in the future. Part of the method (e.g., operations) or system (e.g., modules or functions) according to various embodiments of the present invention disclosure can be implemented with instructions that can be conducted via various types of computers and stored in computer-readable storage media, as types of programming modules. The processor (e.g., processor 120) can execute instructions, thereby performing the functions. Examples of computer-readable media include: hard disks, floppy disks, magnetic tape, optical media (e.g., CD-ROM disks, DVDs, magneto-optical media, floptical disks, etc.), built-in memory, etc. Examples of the instructions include machine codes which are produced by compilers or can be executed by interpreters. Modules or programming modules according to various embodiments of the present invention disclosure may include at least one of modules, remove part of the modules described above, or include new modules. The operations performed by modules, programming modules, or the other modules, according to various embodiments of the present invention disclosure, may be executed in serial, parallel, repetitive or heuristic fashion. Part of the operations can be executed in any other order, skipped, or executed with additional operations.

The invention claimed is:

1. An antenna device comprising:

a slot formed by a second connection pattern, a second ground pattern, a third ground pattern, and a fourth ground pattern;

a feeding part formed on a surface different from a surface on which the slot is formed; and a metal pattern deployed to extend for a predetermined distance from the feeding part and configured to form vertical polarized waves, wherein the metal pattern is deployed at a predetermined angle to the surface on which the slot is formed, and wherein the second connection pattern and a first connection pattern disposed to face the second connection pattern electrically connect the second ground pattern and a first ground pattern disposed to face the second ground pattern.

2. The antenna device of claim 1, wherein the metal pattern is deployed vertically to the surface on which the slot is formed.

3. The antenna device of claim 2, further comprising a substrate connected to the third ground pattern.

4. The antenna device of claim 3, wherein the metal pattern is formed on a lower surface of the substrate.

5. An antenna device comprising:

a first metal pattern electrically connected to a first feeding part formed on a surface on which a first ground pattern is formed and configured to radiate horizontal polarized waves;

a second metal pattern deployed in a position spaced apart for a predetermined distance from the first metal pattern, and electrically connected to a second feeding part formed on a surface different from a surface on which a second ground pattern formed spaced apart from the first ground pattern is formed, and configured to generate vertical polarized waves;

a connection pattern configured to connect the first ground pattern and the second ground pattern to each other; and a slot deployed base on the surface on which the first ground pattern is formed and the surface on which the second ground pattern is formed.

6. The antenna device of claim 5, further comprising a substrate, wherein the first metal pattern is formed on a first surface of the substrate, and the second metal pattern is formed on a second surface facing the first surface of the substrate.

7. The antenna device of claim 6, wherein the connection pattern comprises:

a first connection pattern configured to connect the first ground pattern and the second ground pattern to each other and deployed in a direction facing the slot; and a second connection pattern configured to connect the first ground pattern and the second ground pattern to each other and to form one surface of the slot.

8. The antenna device of claim 7, wherein the slot is formed by the second connection pattern, the second ground pattern, a third ground pattern, and a fourth ground pattern, and the second connection pattern forms a side surface portion of the slot, the second ground pattern forms a lower end portion of the slot, the third ground pattern forms an upper end portion of the slot, and the fourth ground pattern forms a side surface portion of the slot.

9. The antenna device of claim 8, wherein the first ground pattern is formed on the first surface of the substrate.

10. The antenna device of claim 5, wherein the first metal pattern is electrically connected to an edge existing in a predetermined distance from a corner created as the connection pattern and the first ground pattern come in contact with each other among edge portions of the first ground pattern.

11. The antenna device of claim 5, wherein the first metal pattern is formed at a corner created as the connection pattern and the first ground pattern come in contact with each other.

12. The antenna device of claim 5, wherein a propagation direction of a radiation pattern radiated from the first metal pattern coincides with a propagation direction of a radiation pattern output from the slot.

13. The antenna device of claim 5, wherein the second metal pattern is connected to an upper end portion or a lower end portion of the slot.

14. An electronic device comprising:

an antenna device; and a controller configured to control an operation of the antenna device, wherein the antenna device includes:

a first metal pattern electrically connected to a first feeding part formed on a surface on which a first ground pattern is formed and configured to radiate horizontal polarized waves;

a second metal pattern deployed in a position spaced apart for a predetermined distance from the first metal pattern, and electrically connected to a second feeding part formed on a surface that is parallel to a surface on which a second ground pattern formed in parallel to the first ground pattern is formed, and configured to generate vertical polarized waves;

a connection pattern configured to connect the first ground pattern and the second ground pattern to each other; and a slot deployed vertically to the surface on which the first ground pattern is formed and the surface on which the second ground pattern is formed, wherein the first metal pattern and the second metal pattern are formed vertically to each other in a direction of a plane that is parallel to the surface on which the second ground pattern is formed, and the controller is configured to control a power supplied to the first metal pattern and a power supplied to the second ground pattern.

15. The electronic device of claim 14, wherein the controller is configured to generate polarized waves as controlling phases of a power supplied to the first metal pattern and a power supplied to the second metal pattern, and the polarized waves comprise any one of the vertical polarized waves, the horizontal polarized waves, and circular polarized waves.

* * * * *